United States Patent [19]

Price

[11] 4,090,266

[45] May 23, 1978

[54] SWIMMING POOL CONSTRUCTION

[76] Inventor: John W. Price, P.O. Box 783, Moncton, New Brunswick, Canada

[21] Appl. No.: 667,018

[22] Filed: Mar. 15, 1976

[30] Foreign Application Priority Data

May 17, 1976 Canada ..... 242142

[51] Int. Cl.[2] ..... E04H 3/16

[52] U.S. Cl. ..... 4/172.19; 52/169.7

[58] Field of Search ..... 4/172; 52/169.7, 169.8

[56] References Cited

U.S. PATENT DOCUMENTS

| | | | |
|---|---|---|---|
| 3,015,191 | 1/1962 | Lucchesi | 4/172.19 |
| 3,064,273 | 11/1962 | Kwake | 4/172.19 |
| 3,094,709 | 6/1963 | Miccio et al. | 4/172.19 |
| 3,631,545 | 1/1972 | Orndorff | 52/169.7 |
| 3,638,378 | 2/1972 | Russ | 4/172.19 |
| 3,739,539 | 6/1973 | Posnick | 52/169.8 |

*Primary Examiner*—Robert I. Smith

[57] ABSTRACT

A wall assembly for a swimming pool comprising a concrete footing for supporting the assembly, fiberglass panel members extending upwardly from the concrete footing, the bottoms of which are imbedded in the footing, and vertically extending concrete columns located on the outside of and providing lateral support for the panel members. The panel members are arranged side-by-side in a row about the periphery of the pool. The concrete columns are supported at their bottoms on the concrete footing. One concrete column is positioned along the length of each joint between two adjacent panel members whereby the joints between the members are sealed by the concrete columns. A method is also provided for erecting the wall assembly.

11 Claims, 6 Drawing Figures

SWIMMING POOL CONSTRUCTION

BACKGROUND OF THE INVENTION

This invention relates to swimming pools and is directed particularly to and a novel wall assembly for swimming pools.

A known system of construction comprises laying steel reinforced high strength concrete in the bottom of a pool up to and encasing the bottom of suspended fiberglass panels. These prefabricated panels are flat and flexible and are bent or straight depending on the desired pool shape. The known method of construction however does not provide proper lateral support for the fiberglass side panels. The result of this lack of support is warping and deflection of the panels during back filling operations and displacement of the pool sides by frost and ground movements.

Most pools are also provided with a coping or walkway extending about the periphery of the pool. Frost and ground movements can damage or displace this coping or walkway which may or may not be connected to the sides of the pool.

A common method employed to combat frost and ground movement of the coping or walkways is to tie the coping or walkway into a plastic or metal fastening member or trim molding, slip fitted down onto the top edge of the pool panels. The disadvantages of this, however, are that frost heaving of the back fill material can lift the coping clear off the panel. If the panel then becomes deflected the coping will not drop back into place when the ground settles. Furthermore, settlement of back filled ground under the coping or walk causes the coping or walk to settle and places a severe and damaging strain on both the panel edge and the coping or walkway.

In addition according to the above system of construction fiberglass pool panels must be disigned without an integral or molded in flange at the top because the panels must accept the grooved slip fit fastening member. Such a design permits a great amount of flexibility in the panel which is good for building kidney, oval and many other multi-curve design swimming pools, but it lessens the ability of the top of the panel to resist undesirable bending when the panel is finally in place. To build a good looking rectangular or straight sided pool with such panels is very difficult unless the panel manufacturer has imbedded iron angle or other reinforcing members into the backside of the panel, clear of the slip fit fastening strip in order to give the top portion of the panel sufficient strength to resist bending. Panels not thusly reinforced are too flexible. Panels with such reinforcing members are not however suitable for pools with curved sides because they cannot be bent as desired.

SUMMARY OF THE INVENTION

Accordingly, the present invention provides a wall assembly for a swimming pool comprising a concrete footing for supporting said assembly, fiberglass reinforced or metal panel members extending upwardly from said concrete footing and arranged side by side in a row, the bottom edges of said panel members being embedded in said concrete footing, a flange formed on each vertically extending side edge of each panel member with adjacent flanges of adjacent panel members being connected together by mechanical fasteners, vertically extending concrete columns located on the outside of and providing lateral support for said panel members and supported at their bottoms on and connected to said concrete footing, one concrete column extending from the top of each joint between two adjacent panel members to the concrete footing, the majority of columns being spaced apart from immediately adjacent columns in the row a distance at least as great as the greatest thickness of the column measured in the direction of the row of panel members, horizontal reinforced concrete beam means rigidly joining the top of each concrete column to each adjacent concrete column and supported on said concrete columns, wherein the joints between said members are enclosed by said concrete columns on the outside of the panel members and each pair of connected flanges are embedded in a respective concrete column.

The above construction allows a rectangular or curved shaped swimming pool to be built in a manner similar to the previously used method, but without the problems of panel-side deflection during and after construction. In particular, the use of panel-connected, footing-supported columns allows a fiberglass-concrete swimming pool to be constructed in such a way as to be fully free standing even when up to three feet of vertical wall height is unsupported by back filling, thereby increasing swimming pool strength and reducing or eliminating panel deflection during and after construction.

BRIEF DESCRIPTION OF THE DRAWINGS

In the accompanying drawings, which illustrate preferred embodiments but which in no way are intended to restrict the scope of this invention.

DETAILED DESCRIPTION OF PREFERRED EMBODIMENTS

Figure 1:
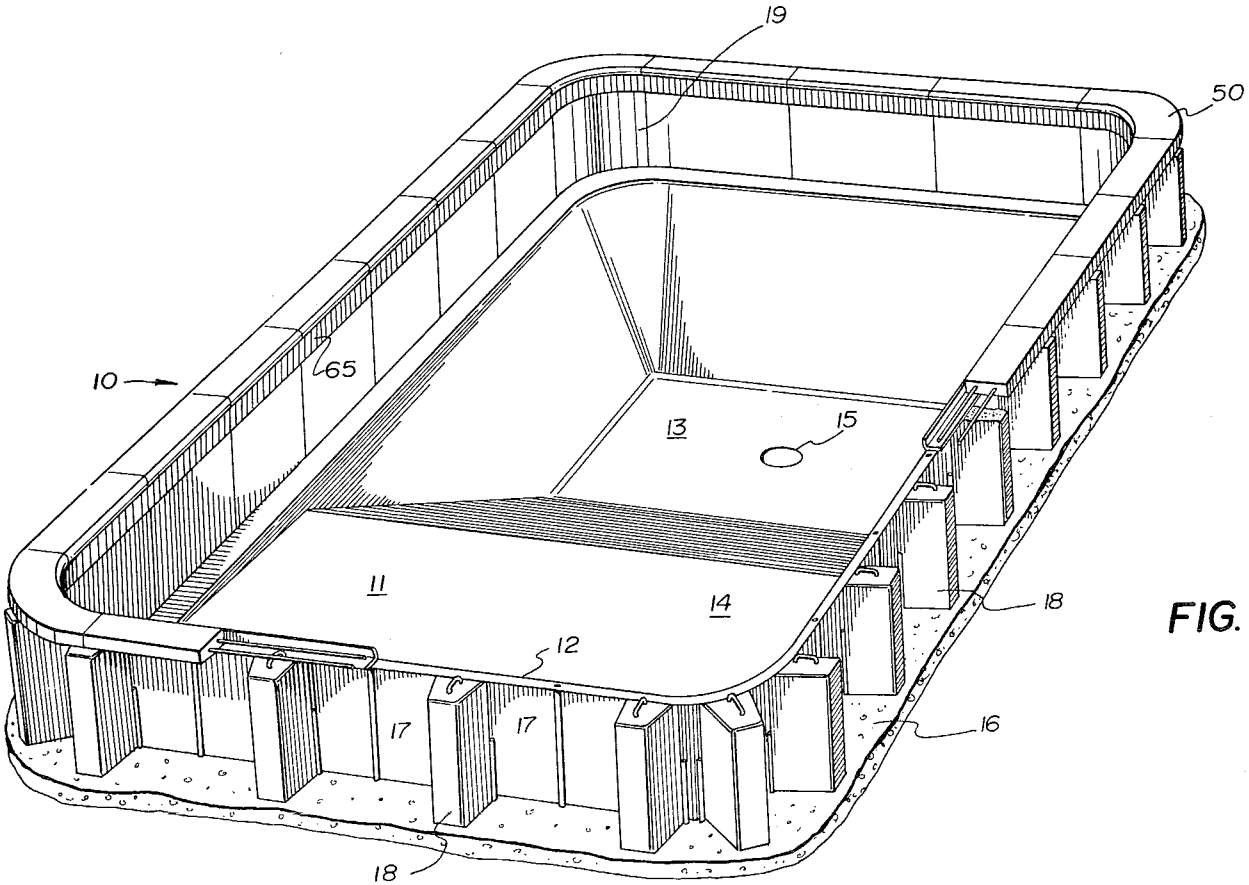
FIG. 1 is a perspective view, partly broken away, of a rectangular swimming pool constructed in accordance with the present invention.

A rectangular swimming pool 10 constructed in accordance with the present invention is shown in FIG. 1 of the drawings. The swimming pool 10 which may be constructed either in a hole in the ground or above ground level, consists of a pool floor 11 and a wall assembly 12. The floor 11, which does not form part of the present invention, can be constructed according to any suitable, known method but, in the illustrated embodiment, it is constructed of reinforced concrete. This floor can be constructed before, at the same time, or after the walls of the pool depending on the particular desires of the builder. In the illustrated embodiment, the pool is provided with a deep end 13 and a shallow end 14 and the deepest portion of the deep end has a suction point 15 for circulation and drainage so that the pool can be completely drained if desired. For purposes of illustration, no earth or backfill is shown on the outside of the walls of the pool but it will be understood that earth or backfill is placed against the outside of the pool walls to provide additional support for these walls when the pool is completed. The ground surrounding the completed pool will also, of course, provide ready access to the pool from all sides. Particularly in climates which have freezing conditions during the winter, the backfill that should be used when filling in the excavation along the outside of the completed pool walls should be of a type that will not retain water, for example, sand or fine gravel, in order to prevent undue and unnecessary forces acting on the pool walls because of the heaving of the surrounding ground. If the excavation for the pool is in clay soil, it may be necessary or desirable to provide a drainage system into which water in the backfill around the pool can drain.

The wall assembly 12 of the present invention, as can be seen from FIG. 1, consists of three basic sections, these being the base support means 16 for supporting the wall assembly, panel members 17 which extend upwardly from the base support means, and vertically extending concrete columns 18 located on the outside of and providing lateral support for the panel members. The panel members 17 are arranged side by side in a row to form each wall of the pool. In the pool shown in FIG. 1, the panel members 17 are primarily flat except for the corner panel members 19 which are curved. If an oval or round pool is being constructed, the panel members could be prefabricated so that they have the shape necessary to form the desired pool, although the use of such shaped panels in lieu of flat panels is not essential as explained hereinafter. If a circular pool is to be constructed, each shaped panel member would have the same slight curve from one side to the other. As will be explained in more detail hereinafter, a concrete column 18 is positioned along each joint between two adjacent panel members and extends from the top of the joint to at least the base support means. With this arrangement, the joints between the panel members are substantially enclosed on the outside of the panels members and supported by the concrete columns.

Figure 2:
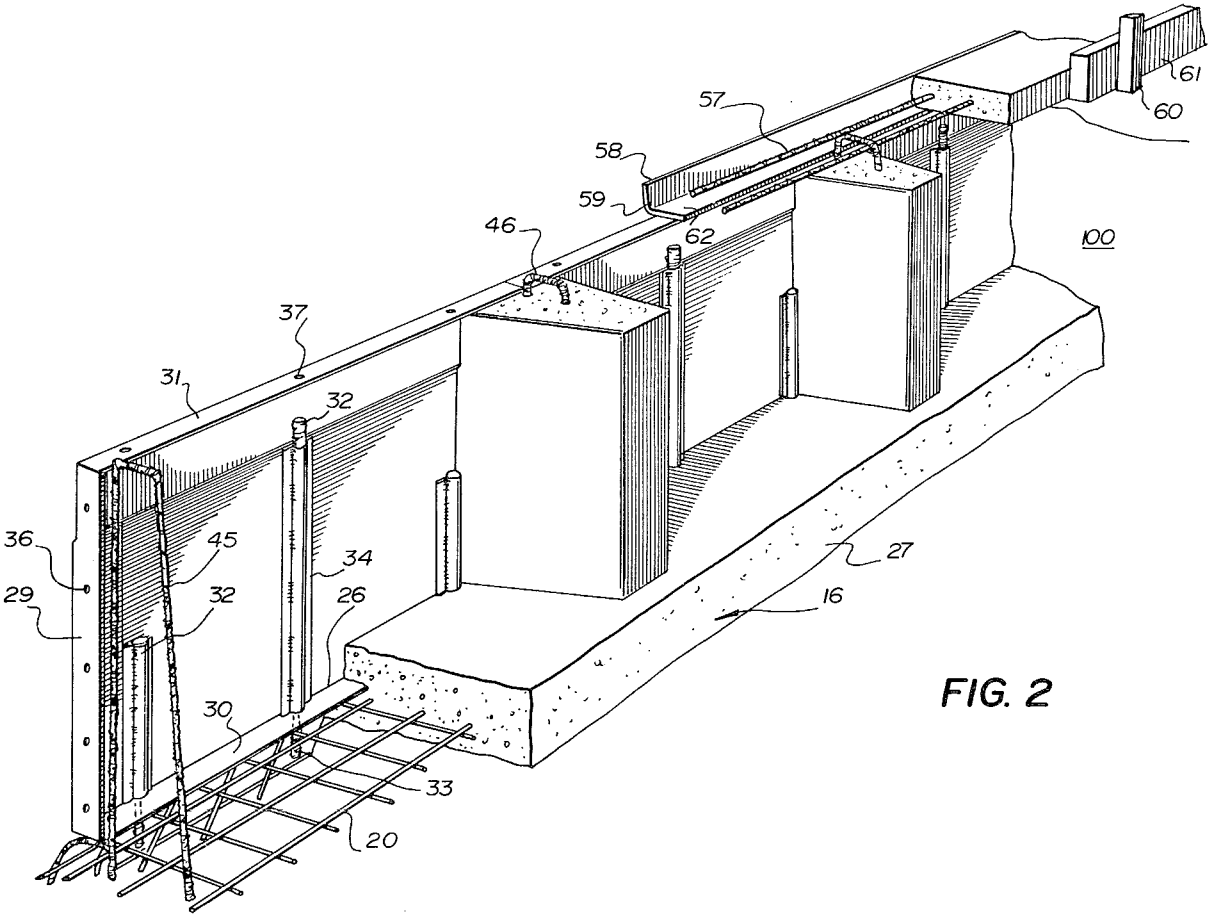
FIG. 2 is a perspective view, partly broken away, of the wall assembly and support therefor of the pool of FIG. 1.

As can be seen clearly from FIGS. 1 and 2, the majority of columns are spaced apart from adjacent columns in the row a distance at least as great as the greatest thickness of the column measured in the direction of the row of panel members. However some columns may be spaced closer together in regions of high stress, such as the corners as shown in FIG. 1.

The preferred form of base support means 16 is best seen in FIG. 2 and consists of a concrete footing extending the length of the wall assembly. The concrete footing, like the pool floor 11, is reinforced with a network of steel reinforcing rods 20 or wire mesh supported above the ground until the concrete footing is laid. The concrete footing is laid directly on the surface of the ground after the panel members 17 have been placed in their proper positions along with the forms 25 for the columns 18. As can be seen from FIGS. 2 and 4, the bottom edges 26 of the panel members are preferably embedded in the concrete footing. This construction helps to ensure that water in the pool will not leak out between the bottom of the panel members 17 and the concrete pool floor or the concrete footing. The outer surface 27 of the concrete footing can either be formed against the side of the excavation or any suitable cement forms can be used. These forms can consist, for example, of wooden planks arranged end to end and supported on their sides by stakes. The inside surface of the concrete footing is defined by the periphery of the pool floor 11 which can be formed by dry packing before or at the same time as the concrete footing for the wall assembly 12. The reinforcing rods 20 or wire mesh in the concrete footing extending perpendicularly to the panel members 17 can simply be an extension of the reinforcing rods or wire mesh used in the pool floor 11. The inner portion of the concrete footing, that is the portion inside of the panel members 17, forms in fact part of the pool floor. Preferably a safety ledge 28 is formed by the inner portion of the concrete footing. Persons standing on this ledge can support their heads above the surface of the water without swimming.

The panel members 17 are preferably made of fiberglass reinforced polyester, a very strong material which is easy to work with because of its lightness. However other materials can also be used such as mild steel, stainless steel, and aluminum. Fiberglass reinforced polyester does not corrode with time and is relatively inexpensive. As can be seen from FIGS. 2 and 3, each panel member 17 is formed with two side flanges 29, a bottom flange 30 and an upper flange 31. Each of these flanges extends the entire length of the respective edge of the panel and is an integral part of the panel member. Also, each flange extends perpendicularly to the inner surface of the panel member and in an outward direction from this inner surface which is the surface in contact with the water of the pool. Each panel member is prefabricated using known fiberglass-forming techniques.

In order to give increased strength to the panel members 17, steel or plastic tubes 32 can be bonded to the outer surface of each panel member. These steel tubes can be of different lengths as illustrated in FIG. 2. In the illustrated embodiment, each panel member has a long tube 32 located midway between the sides of the panel member and extending from the bottom edge of the panel member to a position just below the top edge. Each panel member is also provided with two short tubes 32 which extend from the bottom edge of the panel member to a position approximately midway between the bottom edge and the top edge of the panel member. Preferably an opening is formed in the bottom flange 30 adjacent the bottom end of each tube. With this construction, a length of steel reinforcing bar 33 can extend through the hollow center of the tube and down into the concrete footing when it is laid. In this manner, each steel tube 32 is firmly supported so that it will not tend to be displaced sideways by lateral forces acting on the panel members. The tubes 32 are bonded to the back of the respective panel member 17 by means of surrounding layers 34 of fiberglass reinforced polyester. The tubes can be affixed to the outside of the panel member when the latter is formed by use of the above mentioned molding techniques. If desired, each tube can be completely encased by the outside surface of the panel member and by layer 34 to increase the panel rigidity. In the embodiment illustrated in FIG. 2, the two steel tubes on each panel member are located adjacent to but outside of the forms 25 for the concrete columns. It is of course possible to have all of the tubes 32 of the same length as the shorter tubes 32 illustrated in FIG. 2. Instead of the arrangement shown in FIG. 2, one could, for example, use four short tubes 32 on the back of each panel member. However for maximum panel strength and rigidity, at least one tube extending the full height of the panels should be provided for each four feet of panel length.

Figure 3:
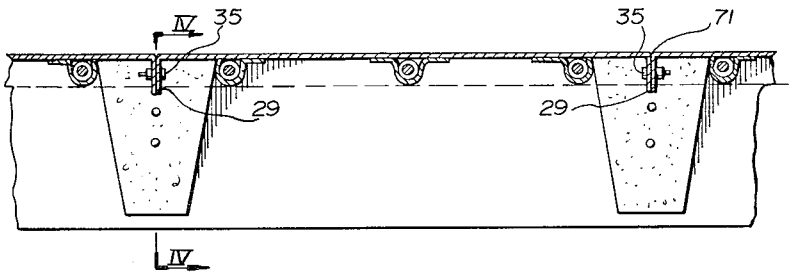
FIG. 3 is a sectional plan view of the wall assembly taken along line III—III of FIG. 4.

The side flanges 29 permit adjacent panel members to be connected together by means of the nuts and cadmium plated bolts 35 shown in FIG. 3. These bolts extend through a number of holes 36 formed in each side flange 29. These holes could, for example, be formed by means of a hand drill at the pool site or, preferably, they are formed at the factory prior to transporting the panel members to the pool site. Similarly, holes 37 can be formed in the upper flange 31 of each panel member, these holes being used for a purpose described hereinafter. Before the flanges 29 are connected, a waterproof caulking compound can be applied to the outside of one or the other or both of adjoining flanges 29. This compound supplements the sealing of the joints between the panels by the columns 18.

Figure 6:
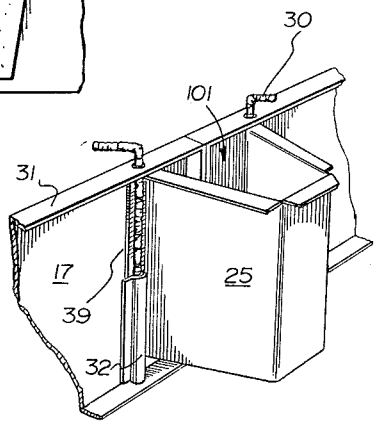
FIG. 6 is a sectional elevation illustrating the method of constructing the concrete columns.

Once the panel members 17 have been erected at the pool site, the forms 25 can be attached to the rear surface of the panel members. Each form 25 has a generally U-shaped cross-section when viewed from the top and is made from a suitable, rigid material such as steel or wood. Preferably, the forms are made of steel in order that they can be used a number of times. FIG. 6 illustrates a manner in which the forms 25 can be attached to the rear of the panel members. After laying the concrete footing, the forms 25 are affixed to the panel members by means of two L-shaped steel bars 38 extending through holes in flange 31 down behind flanges 39 and partway into the tubes 32. A flange 39 is formed on each edge of the form 25 where the form 25 is connected to the respective panel member. The flange 39 extends outwardly from the interior of form 25 and is parallel to the panel member.

It will be noted from the above that the concrete form for each column 18 consists of the combination of one of the forms 25 and a side edge area 101 of the rear surface of each of the respective two adjacent panel members. This results in the side flanges of the panel members being firmly connected together as they are embedded in concrete.

Before the concrete footing is laid and the forms 25 are arranged in their proper positions, a U-shaped reinforcing bar 45 is placed at the desired position of each concrete column 18 (See FIG. 2). Two forms of this reinforcing bar are shown in the drawings. The reinforcing bar 45 shown in FIG. 2 has a vertical leg positioned a short distance outwards from the side flange 29 of the adjacent panel member. The other leg of the bar 45 is arranged at a slight angle to the vertical and lies in the same vertical plane as the side flange 29. When the concrete columns have been formed, the top portion 46 of the bar projects from the top surface of the concrete column. Alternatively the top of the bar 45 can be made flush with the top of the concrete column.

Figure 4:
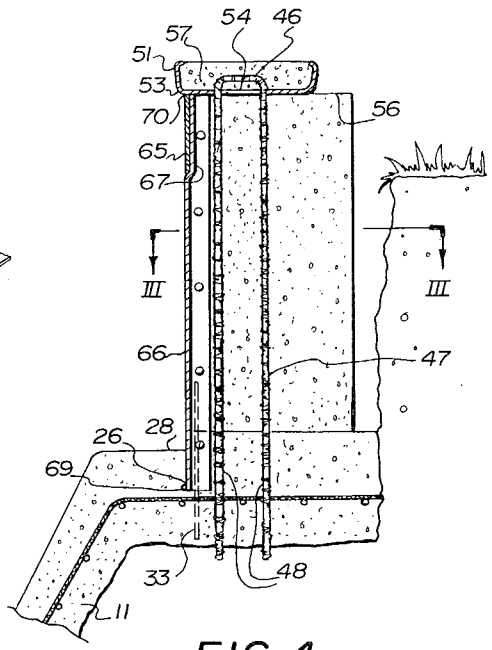
FIG. 4 is a sectional elevation of the wall assembly taken along line IV—IV of FIG. 3.

The other possible shape for the reinforcing bar in each concrete column is illustrated in FIG. 4 where the reinforcing bar 47 has two vertical legs. Otherwise, the bar 47 has the same arrangement as bar 45. It will be noted that the bottom portions 48 of each leg of bars 45 and 47 projects well into the region of the concrete footing and is preferably tied to the reinforcing rods 20. Thus bars 45 and 47 will firmly connect the concrete columns to the concrete footing on which they rest. Alternatively, the illustrated reinforcing bars 45 and 47 can be turned upside down so that the portion connecting the two legs is at the bottom and is embedded in the concrete footing. In this case the ends of the legs will either extend above the top of the column or be flush with the top of the column.

The concrete for the columns 18 can be poured either at the same time as the concrete for the base support means 16 or subsequent to the pouring of the concrete for the base support means. If the latter method is used, the already formed concrete footing can be used to support the bottom ends of the forms 25 when concrete is being poured into these forms. It will be noted that the forms 25 do not extend to the bottom of the panel member 17. In fact, after the concrete footing has been poured, the bottom end 49 of each form 25 should either be resting on top of the concrete footing or should project only a slight distance into the concrete footing to a depth no greater than ¼ inch at any point. With this arrangement, the form 25 can be easily removed for further use after the concrete column has been formed. One need only remove the two steel bars 38 and then pry the form 25 outwards and away from its respective panel members.

Figure 5:
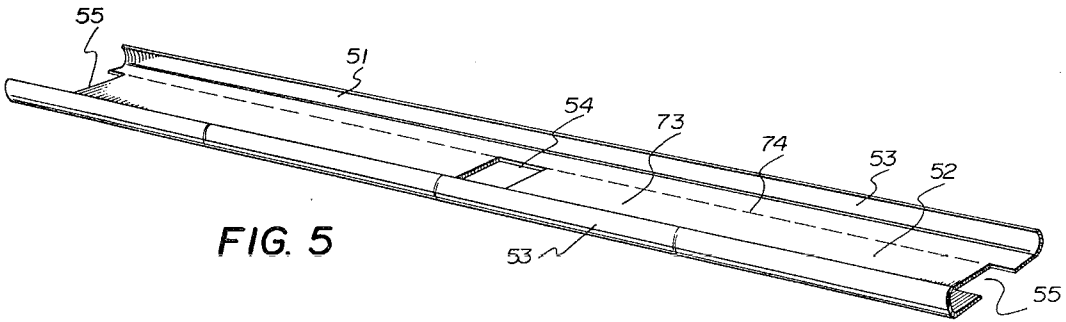
FIG. 5 is a perspective view of the channel-shaped form used to form the coping at the top of the wall assembly.

In the preferred embodiment of the present invention, the adjacent concrete columns are joined at their tops by and support a horizontal beam member 50. The illustrated beam member is constructed of reinforced concrete and links a number of concrete columns together. In fact, as shown in FIG. 1, the beam member extends completely about the periphery of the pool and is made of one continuous piece of reinforced concrete. The beam 50 can either be formed before or after backfilling occurs to bring the ground level up to the top of the edge of the panel members. Whether backfilling occurs before or after will depend to some extent on the shape of the pool and the particular method used to construct the beam. If a straight-sided pool is being constructed, it is possible to construct the beam member before backfilling with the use of the channel-shaped member 51 shown in FIG. 5. This member 51, which is preferably made of fiberglass, has a relatively wide bottom 52 and two, relatively short, upstanding legs 53. Each leg 52 has a slight, inwardly facing concave curvature. Midway along the length of the member 51 is a rectangular opening 54 which is located in the bottom 52. In one embodiment, this opening has a width of four inches taken in the direction of the length of member 51 and a length of five inches in the transverse direction of member 51. At each end of the member 51 is a rectangular notch 55 and, when one notch 55 is placed opposite another notch 55 of an adjacent member 51, an opening identical to opening 54 is formed. The purpose of the opening 54 and notches 55 is to accommodate the top portions 46 of the reinforcing bars 45 when the member 51 is placed on top of the columns 18 as shown in FIG. 4. The opening 54 is placed over a center portion of one of the columns 18 so that the center of the member 51 rests on the column and the top portion 46 of the bar projects through the opening. One end portion of the member 51 rests on one of the two adjacent columns 18 while the other end portion of the member 51 rests on the other adjacent column. As many members 51 are arranged end-to-end about the circumference of the pool as necessary. The bottom 52 of each member 51 is firmly attached to the adjacent upper flange 31 of the panel member 17. In order to do this, galvanized nails can be driven through the bottom 52 and the upper flange 31. Alternatively, holes can be preformed in the bottom 52 at the same intervals as the holes 37 formed in the upper flange. With the use of these preformed holes, nuts and bolts can be used to firmly affix the member 51 to the upper flange. It will be noted that when the number 51 is attached in its proper position, the inner edge of member 51 projects slightly beyond the inside surface of the panel members 17. The bottom 52 can be of various widths depending on the particular design desired for the pool. For example, the bottom 52 can cover completely the tops of the adjacent columns 18. Alternatively, the bottom 52 need only be about three quarters of the width of the adjacent columns 18 as shown in FIG. 4. With this arrangement, a ledge 56 is formed between the member 51 and the outer wall of the column. This ledge may be used to support a concrete or wooden walkway for example or the floor of a patio.

Once the member 51 has been attached, reinforcing bars 57 are preferably placed in the interior of the member 51. These bars should be supported above the bottom 52 in order that the concrete when poured will completely surround them and prevent corrosion of the bars. One of the bars 57 should preferably extend through the loop formed by the top portion 46 of the bar 45 in order to ensure a firm and lasting connection between the completed coping and the respective concrete column on which it rests. After the bars 57 have been properly positioned about the circumference of the pool, the concrete can be poured into the member 51 to form the coping 50 with the member 51 acting as a form for this cement. The member 51 is completely filled with the concrete as shown in FIG. 4 and the concrete is leveled and smoothed to form a flat surface having a pleasing appearance. It will be noted that the channel-shaped member 51 is left in place after the coping 50 has been formed. The members 51 are made of fiberglass reinforced polyester, vinyl plastic or other material that will not corrode with the passage of time and thus will always present a pleasing appearance to the user of the pool. In addition, the inner leg 53 of the member provides a smooth surface for the hand to grip when the pool is being used. If the member 51 is coloured, it will also increase the beauty of the finished pool.

In order to form the curved corners of the rectangular pool shown in FIG. 1, channel-shaped members similar to members 51 can be formed, these members having the necessary curvature from one end to the other. It will be appreciated that, in this particular case, four identically shaped members can be used for the four corners of the pool and thus the same mold can be used to form the four members.

In lieu of the above described method which permits backfilling around the pool after the beam is formed, the method illustrated in FIG. 2 can be used if backfilling is carried out after the columns 18 are formed. For purposes of illustration, only a bit of the backfill 100 is shown in FIG. 2 but it will be understood that backfill is placed in the excavation up to the level of the top of the panel members and columns 18. Before or after backfilling takes place an angle member having a L-shaped cross section is attached to the upper flange 31 of the panel member. This angle member 58 is attached in the same manner as described above in connection with channel-shaped member 51. One leg 59 has a curvilinear shape in cross section similar to the shape of the legs 53 of member 51. The other leg 62 of the member 58 is flat and this is the leg that is affixed to the upper flange 31. As with member 51, the inner portion of the angle member 58 projects slightly beyond the inner surface of the adjacent panel member 17. The outer form for the concrete used to form the coping or beam 50 is constructed in a well known manner using a strip of rigid material or boards and stakes driven into the backfill or surrounding ground. One of the stakes 60 and a board 61 is illustrated in FIG. 2. Once the concrete coping or beam 50 has been formed, the stake 60 and boards 61 are of course removed and can be used again at a different site if desired. The angle member 58 is not removed after the beam is formed but remains in place to form the inner side surface of the beam. As in the previous method, before the concrete for the beam is poured, reinforcing bars 57 are placed in the space between the angle member 58 and the board 61.

It will be noted that the above described method is particularly suitable for the formation of pools having curved sides such as kidney-shaped pools or oval pools. By cutting the bottom leg of the angle member 58 at short intervals along the length of member 58, these cuts extending transversely the entire width of bottom leg 62, the angle member 58 can be bent to any desired curvature and then affixed to the top of the correspondingly curved panel members 17. The flexible board 61 can likewise be bent in the desired shape to form the curved outer surface of the beam.

The advantages of the beam 50 of the present invention can be readily appreciated from the above mentioned description of it. First of all, the beam is very strong because it is constructed of reinforced concrete and is thus able to support considerable weight or loads. It also presents a pleasing appearance to the eye because of the use of a moulded fiberglass or vinyl plastic inner surface along the beam edge. It can also be manufactured quickly and easily at the job site by relatively unskilled personnel since, aside from the use of the special members 51 or 58, its construction merely requires the use of known techniques for forming reinforced, concrete structures. Because the beam 50 preferably links the top of all of the vertical columns 18 together, it strengthens these columns and permits them to resist greater forces on the sides of the pool. It will be appreciated that a rigid, reinforced concrete grid is formed by the combination of the concrete footing, the columns 18, and the beam 50.

If desired, the upper ends of the columns 18 can be widened by the use of suitable forms in order that the columns 18 can provide better support for a wider coping 50 or a complete walkway. In climates where deep ground freezing occurs vertical column sides or sides tapering into the top of the column are preferable. In any case it is preferable to surround the exposed sides of each column with one or two layers of heavy building paper before backfilling. This will prevent severe ground movement from acting on the columns in an upward direction. In order to improve the appearance of the pool tiles 65 can be affixed to the upper portion of the inner surface of the panel members 17 as shown in FIGS. 1 and 4. In order to accommodate these tiles and in order to provide a flat surface formed by the tiles 65 and the lower portion 66 of the panel member, the upper portion 67 of each panel member can be slightly recessed, the depth of the recess corresponding to the thickness of the tiles 65. The tiles 65 can be affixed to the panel members 17 by any suitable tile adhesive capable of firmly connecting the tiles to a fiberglass surface.

Instead of using the beam 50 at the top of the pool wall, one can increase the width of the top flange 31 of each panel member which will in turn increase the rigidity of the panels. Sufficient rigidity of the panels between the columns 18 will make the reinforced concrete beam unnecessary in some applications. Attachment of a standard vinyl plastic coping to the flange 31 will serve to finish the pool edge.

Although the concrete footing and the concrete floor of the pool substantially prevent any leaks at the bottom of the panel member 17, it is desirable to use a caulking compound on the inside surface of the panel members where these members are imbedded in the concrete. For example, a bead of caulking compound can be place near the bottom of the panel members at 69 prior to the placing of the concrete floor. In addition, in order to prevent water from seeping in between the channel-shaped member 51 and the top of the adjacent panel members, caulking can be placed in the joint at 70 prior to affixing the member 51 to the top of the panels. Again, although the concrete columns 18 substantially seal the vertically extending joints between the panel members, a caulking compound can also be used in these joints during erection of the pool walls. This caulking compound, which would be appied in 71 as shown in FIG. 3, will provide a joint which, when suitably cleaned, has a more pleasing appearance.

The flat panel member 17 shown in the drawings can be used to form pools having curved sides as well as pools with straight sides. In the case of curved pools, the bottom flanges 30 and upper flanges 31 of the panel members need only be notched or cut laterally the full width of the flanges in order to permit the panel member 17 to be bent into the desired shape. It will be noted that cutting the flanges in this manner will not substantially weaken the finished pool structure since the concrete footing and beam will provide more than sufficient support for the top and bottom edges of the panel members.

The channel-shaped members 51 used to construct the coping 50 should have sufficient depth in their interior to provide a beam 50 having adequate strength to support the weight of people and to resist ground forces caused by frost or otherwise. In one preferred embodiment, the members 51 provided a coping having a thickness of approximately three inches. The members 51 had a length of eight feet and were twelve inches wide.

If desired, the channel-shaped members 51 can be constructed so that the two sides of the member can be broken off from a center portion 73. For example, a fault line 74 can be provided between the center portion 73 and each angle-shaped side portion. When constructing a curve pool which requires the angle members 58 shown in FIG. 2, the side portions of the member 51 can be used and the center portion 73 can simply be thrown away. This avoids the necessity of manufacturing and providing diferent parts for pools of different shape.

A further suitable method of providing an angle shaped member is to use readily available vinyl chloride or aluminum extrusions. They should be sufficiently rigid to act as forms for the poured concrete beam. Notching of the base flange will permit bending the extrusion to any shape of pool.

If a preformed concrete coping stone, brick, tile, flagstone or wood edge is preferred, simply reducing the column height and lowering the top level of beam 50 so that it is flush with the flange 31 will permit any of these finish materials to be bonded to the beam. In this way strength is maintained while a variety of pool edge finishes are possible.

What I claim as my invention is:

1. A wall assembly for a swimming pool comprising a concrete footing for supporting said assembly, fiberglass reinforced or metal panel members extending upwardly from said concrete footing and arranged side by side in a row, the bottom edges of said penal members being embedded in said concrete footing, a flange formed on each vertically extending side edge of each panel member with adjacent flanges of adjacent panel members being connected together by mechanical fasteners, vertically extending concrete columns located on the outside of and providing lateral support for said panel members and supported at their bottoms on and connected to said concrete footing, one concrete column extending from the top of each joint between two adjacent panel members to the concrete footing, the majority of columns being spaced apart from immediately adjacent columns in the row a distance at least as great as the greatest thickness of the column measured in the direction of the row of panel members, horizontal reinforced concrete beam means rigidly joining the top of each concrete column to each adjacent concrete column and supported on said concrete columns, wherein the joints between said members are enclosed by said concrete columns on the outside of the panel members and each pair of connected flanges are embedded in a respective concrete column.

2. A wall assembly for a swimming pool according to claim 1 wherein said beam means is a single beam member which joins a number of said concrete columns together.

3. A wall assembly for a swimming pool according to claim 2 wherein said panel members are rectangular and each is flanged along a bottom and top edge.

4. A wall assembly for a swimming pool according to claim 3 wherein said horizontal beam member is covered along one side by a fiberglass reinforced polyester member having a substantially L-shaped cross-section.

5. A wall assembly for a swimming pool according to claim 4 wherein a horizontal leg of said fiberglass reinforced polyester member is fastened to the flanges at the top edges of said panel members prior to constructing said beam member.

6. A wall assembly for a swimming pool according to claim 2 wherein said beam member includes a U-shaped channel covering the bottom and sides of the reinforced concrete.

7. A wall assembly for a swimming pool according to claim 6 wherein said channel is made of fiberglass reinforced polyester and has holes formed in the bottom thereof in the region above each concrete column, and reinforcing rods extending through said holes firmly connect said beam member to said number of concrete columns.

8. A swimming pool comprising a wall assembly according to claim 1, and a pool floor, said wall assembly extending about the periphery of said floor.

9. A swimming pool comprising a wall assembly according to claim 1, and a concrete pool floor, said wall assembly extending about the circumference of said floor and said concrete footing being an extension of said pool floor.

10. A wall assembly for a swimming pool according to claim 2 wherein said beam member extends over the top edge of said panel members and substantially covers the tops of said concrete columns.

11. A wall assembly for a swimming pool according to claim 2 wherein said beam member is firmly connected to the top of said number of concrete columns by reinforcing members embedded in the concrete of the columns and said beam member.

* * * * *